US008016591B2

(12) United States Patent
Englert et al.

(10) Patent No.: US 8,016,591 B2
(45) Date of Patent: Sep. 13, 2011

(54) FIRE LIGHTER

(75) Inventors: Robert S. Englert, Jamesville, NY (US); Chad G. Keehfus, Jamesville, NY (US); Todd E. Keehfus, Skaneateles, NY (US)

(73) Assignee: Ram Industrial Design, Inc., Syracuse, NY (US)

( * ) Notice: Subject to any disclaimer, the term of this patent is extended or adjusted under 35 U.S.C. 154(b) by 212 days.

(21) Appl. No.: 12/368,396

(22) Filed: Feb. 10, 2009

(65) Prior Publication Data

US 2010/0203459 A1 Aug. 12, 2010

(51) Int. Cl.
*F23D 14/46* (2006.01)

(52) U.S. Cl. ..... 431/345; 431/2; 431/6; 431/7

(58) Field of Classification Search ..... 431/345, 431/2, 6, 7

See application file for complete search history.

(56) References Cited

U.S. PATENT DOCUMENTS

| | | | | | |
|---|---|---|---|---|---|
| 418,316 | A | * | 12/1889 | Gathemann | 431/327 |
| 968,330 | A | * | 8/1910 | Rose | 431/269 |
| 1,017,505 | A | * | 2/1912 | Brandstatter | 126/25 B |
| 1,333,557 | A | * | 3/1920 | Miller | 431/327 |
| 1,451,195 | A | * | 4/1923 | Bagley | 431/202 |
| 1,644,882 | A | * | 10/1927 | Holmes | 431/327 |
| 1,651,165 | A | * | 11/1927 | Thomas | 44/519 |
| 1,835,966 | A | * | 12/1931 | Pochyla | 100/133 |
| 1,965,275 | A | * | 7/1934 | Aronson | 431/127 |
| 2,111,524 | A | * | 3/1938 | Aronson | 431/127 |
| 2,321,157 | A | * | 6/1943 | Rees | 411/521 |
| 2,448,622 | A | * | 9/1948 | Rize | 431/129 |
| 2,480,709 | A | * | 8/1949 | Brown et al. | 431/146 |
| 2,574,968 | A | * | 11/1951 | Harriman et al. | 431/146 |
| 2,722,816 | A | * | 11/1955 | Brautigan | 431/289 |
| 2,854,321 | A | * | 9/1958 | Stanton | 44/540 |
| 3,138,944 | A | * | 6/1964 | Gauthier | 431/145 |
| 3,540,865 | A | * | 11/1970 | Hans | 431/326 |
| 3,688,943 | A | * | 9/1972 | Brown | 220/697 |
| 3,967,512 | A | * | 7/1976 | Soldano | 81/3.07 |
| 3,985,492 | A | * | 10/1976 | Nunemaker | 431/144 |
| 4,013,398 | A | * | 3/1977 | Hendrix | 431/344 |
| 4,118,174 | A | * | 10/1978 | Shirak | 431/289 |
| 4,136,770 | A | * | 1/1979 | Cohn | 206/106 |
| 4,295,241 | A | * | 10/1981 | Woolcock | 15/230.11 |

(Continued)

FOREIGN PATENT DOCUMENTS

FR 2423724 A * 12/1979

*Primary Examiner* — Kenneth Rinehart
*Assistant Examiner* — Jorge Pereiro
(74) *Attorney, Agent, or Firm* — Driggs, Hogg, Daugherty & Del Zoppo Co. LPA

(57) ABSTRACT

A fire lighter apparatus and method for using the apparatus are described herein. The fire lighter apparatus comprises a containment pot that stores a flammable liquid and a wand torch that removably inserts into the containment pot. The wand torch includes a shaft, a handle at one end of the shaft, and an igniting head located at an opposing end of the shaft. The igniting head is removably affixed to the shaft through a non-threaded fastener. This fastener includes a first and a second component, which generally positions the igniting head. The handle further comprises a bended loop, which faces upward when the wand torch is laying flat upon a horizontal surface. The method for using the fire lighter comprises submerging the wand torch in the flammable fluid within the containment pot and lighting the igniting head attached after removal from the flammable fluid within the containment pot.

18 Claims, 2 Drawing Sheets

U.S. PATENT DOCUMENTS 4,372,596 A * 2/1983 Sanders ..... 294/9
4,424,018 A * 1/1984 Lowther, Sr. ..... 431/288
5,261,577 A * 11/1993 Goldstein et al. ..... 220/697
5,358,607 A * 10/1994 Ellis ..... 162/100
5,590,804 A * 1/1997 Crum et al. ..... 220/483
5,833,422 A * 11/1998 Haga et al. ..... 411/526
6,913,010 B2 * 7/2005 Noble ..... 126/6
7,399,324 B2 * 7/2008 Roddenbery et al. ..... 44/530
2003/0084605 A1 * 5/2003 Mertz ..... 44/519
2005/0037300 A1 * 2/2005 Snyman ..... 431/2
2005/0076898 A1 * 4/2005 Noble ..... 126/25 B
2005/0169952 A1 * 8/2005 Roddenbery et al. ..... 424/405
2006/0112615 A1 * 6/2006 Noble et al. ..... 44/530
2006/0204913 A1 * 9/2006 Trinkle ..... 431/288

* cited by examiner

FIRE LIGHTER

FIELD OF THE INVENTION

The following generally relates to a fire lighter and more particularly to a fire lighter that includes a liquid containment pot, a wand torch, and a containment pot lid.

BACKGROUND OF THE INVENTION

Fire starters have been used dating back at least to the colonial days when wood fires were needed for providing warmth and for cooking. A typical fire starter included a cast iron or brass pot configured to hold a flammable liquid such as lamp oil and a stone that inserts into the pot and absorbs the liquid stored therein. The stone was generally pumice or soapstone and would remain submerged in the flammable liquid when not being used to start a fire.

To start a fire, the stone is removed from the pot and lit, and placed beneath the fuel grate of a fireplace. The lit stone would be left beneath the fuel grate until the wood or other fuel source in the fireplace ignited. The lit stone is then removed from the fireplace and placed back in the pot, once sufficiently cooled. Fire lighters of this type can still be found today.

Unfortunately, removing a submerged stone from the containment pot gives rise to the possibility of spilling the flammable liquid. Also, the removal of the stone from beneath the fuel grate of a fireplace may pose problems as the stone may be lit and/or at a high temperature.

SUMMARY OF THE INVENTION

Aspects of the present application address the above-referenced matters and others.

According to one aspect a fire lighter is created, comprising a containment pot that stores a flammable liquid and a wand torch that removably inserts into the containment pot. The wand torch includes a shaft, a handle at one end of the shaft, and an igniting head located at an opposing end of the shaft. The igniting head is removably affixed to the shaft through a non-threaded fastener. The igniting head may be inserted into the flammable liquid to absorb the flammable fluid.

According to another aspect of the present invention, the non-threaded fastener includes a first and a second non-threaded fastener. The non-threaded fastener and the second non-threaded fastener maintain a general position of the igniting head. The non-threaded fasteners may be, for example, push nuts.

According to another aspect of the present invention, the handle comprises a bended loop. The bended loop allows the handle to rest with the bended loop facing upward when the wand torch is laying flat upon a horizontal surface. The bend may be between, for example, 50 and 75 degrees.

One aspect of the present invention includes method for using a fire lighter, which comprises submerging the wand torch in the flammable fluid within the containment pot and lighting the igniting head after removal from the flammable fluid. The wand torch may thereafter be placed beneath a grate containing flammable materials. The wand torch may be extinguished once the grate containing the flammable materials is ignited. Another aspect of the invention further comprises removing the igniting head from the wand torch and replacing the igniting head with a second igniting head, the non-threaded fastener allowing for removal of the igniting head.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE INVENTION

Figure 1:
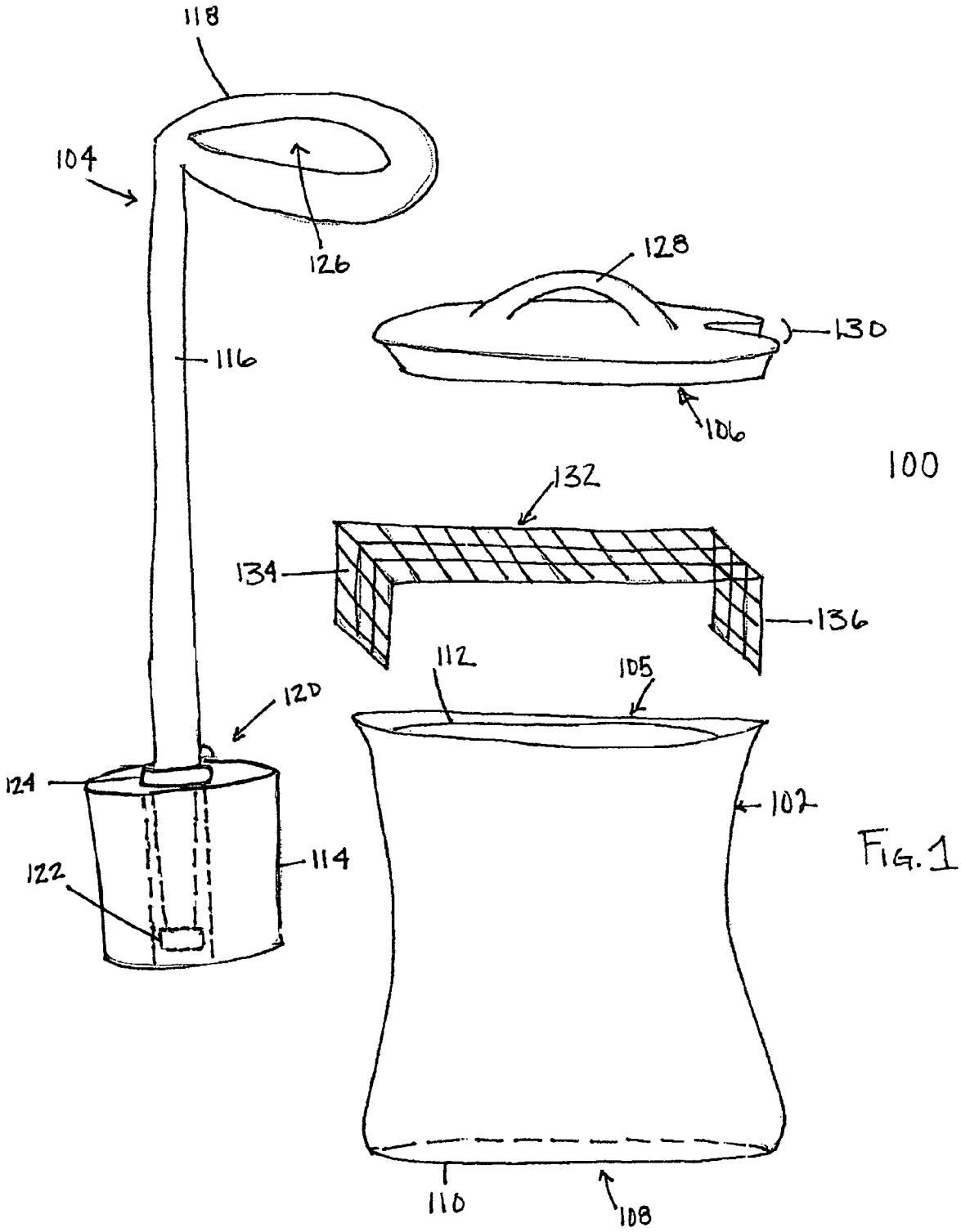
FIG. 1 illustrates a fire lighter.

FIG. 1 illustrates a fire lighter 100. The fire lighter 100 includes a containment pot 102 configured to store a flammable liquid, a wand torch 104 that inserts into the containment pot 102, and a containment pot lid 106.

The illustrated containment pot 102 is generally hour-glass shaped, with an open top end 105 and a closed bottom end 108 with a generally planar surface 110. The flammable liquid is inserted into the containment pot 102 through the open top end 105. The generally planar surface 110 rests on a generally horizontal surface when the containment pot 102 is placed in an ordinary upright position on a floor or other surface.

The illustrated containment pot 102 includes a ledge 112 located inside the containment pot 102, near the top open end 105. In other embodiments, the ledge 112 can be otherwise located inside the containment pot 102 and/or on the outside of the containment pot 102. In one instance, the containment pot 102 is formed with a composite material such as a slip cast ceramic material or other material, including a material that can be glazed. A suitable glaze includes, but is not limited to, a gloss glaze, which may inhibit absorption of the flammable liquid by the containment pot 102. Such a glaze may coat the outside, the inside or both the outside and the inside of the containment pot 102.

In one non-limiting embodiment, one or more indentations are located on the planar surface 110. In one instance, the indentations are positioned with respect to each other to form a recess that fits over a standard size brick. In another non-limiting embodiment, the planar surface 110 includes a gritted material. Such a material may mitigate or reduce slippage of the containment pot 102 on a surface such as a varnished, wood, a ceramic tile, or brick floor, fireplace hearth or mantle surface. In another embodiment, a diameter of the closed bottom end 108 is configured to fit into or over a decorative holder or fire place accessory stand. In yet another embodiment, the closed bottom end 108 may include stabilizing feet upon which the containment pot 102 may stand.

The wand torch 104 includes an igniting head 114, a shaft 116 and a handle 118. The igniting head 114 is releasable or removably affixed to a first end 120 of the shaft 116. In the illustrated embodiment, the igniting head 114 and the shaft 116 are coupled via a non-threaded fastener which includes a first and second fastener 122 and 124, which are respectively affixed to the igniting head 114 and the shaft 116. The fasteners 122, 124 are non-threaded fasteners such as push-on or push nut fasteners. When coupled together, the first fastener 122 and the second fastener 124 maintain the general position of the igniting head 114.

Such a two-fastener configuration allows for multiple igniting heads to be selectively and alternately affixed to the shaft 116. This allows for easy replacement of a worn igniting head 114 or exchanging the igniting head 114 based on the types of fuel. In some previous fire lighters, the igniting heads were generally hand-threaded onto the handle. Threading such as the type used in previous devices has a tendency to deteriorate after repeated increases and decreases in temperature, and the deterioration generally does not allow for easy removal of the igniting head.

The illustrated igniting head 114 is generally cylindrically shaped and formed of an absorbent nonflammable material such as an unglazed ceramic refractory material like fire brick or soapstone or other material. As such, when the igniting head 114 is submerged inside the containment pot 102 in a flammable liquid for a period of time, the igniting head 114 absorbs the flammable liquid. Generally, ceramic refractory materials retain fluids upon and near the surface of their bodies and thus the flammable liquid will not soak entirely through the igniting head 114. When lit, the flammable liquid burns off the igniting head 114.

The shaft 116 is formed of a material that may be heated to a high temperature without substantially losing shape. An example of a suitable material is cold rolled steel or the like. The shaft 116 includes a bend that forms the handle 118, which includes a loop 126 that allows the wand torch 104 to be grasped with a human hand, a pair of tongs, a hooked poker or otherwise. The handle 118 may include a thermally insulating material.

The handle 118 is twisted in such a manner that when the torch wand 104 is placed under a fuel grate (e.g. flat on the ground), the loop 126 will remain in or re-position to a first position. This allows the torch wand 104 to be "self-righting" so that it may be grasped by hand, tongs or poker. In one non-limiting instance, the bend in the shaft 116 is in a range from 50 to 75 degrees, such as for example, 60 or 65 degrees.

The lid 106 can be formed so as to be removable from the open top end 105 of the containment pot 102. In one instance, the lid 106 sits on the ledge 112 when placed on the containment pot 102. The illustrated lid 106 includes a handle 128 that protrudes outwardly from a top surface, which is opposite a surface facing the containment pot 102 when the lid 106 is installed on the containment pot 102.

The handle 128 may be located at about a center of the lid 106, for example, along a central axis or in another aesthetically pleasing location. The handle 128 includes a textured surface or grip that facilitates removal of the lid 106 from the containment pot 102. The handle 128 may also include a thermally insulating material.

The illustrated lid 106 includes a recess or notch 130 through which the shaft 116 of the torch wand 104 extends when the torch wand is inserted in the containment pot 102 and the lid 106 is installed on the containment pot 102. The notch 130 may be formed, for example, to allow the shaft 116 to rest against a side of the containment pot 102. In addition, the containment pot 102 may include a recess within which an inserted torch wand 104 may rest whether or not the lid 106 is installed on the containment pot 102.

An optional removable liner 132 can be removably installed in the containment pot. The removable liner 132 may cushion the igniting head 114 when the wand torch 104 is inserted into the liquid containment pot 102. The removable liner 132 may protect a glazed inside surface of containment pot from damage, such as for example, scratches occurring from the igniting head. The liner 132 may include an open mesh material, for example, expanded metal or wire screening. The liner 132 may also be configured to rest upon the inside bottom surface of the liquid containment pot 102 or may be arranged to rest slightly above the bottom of the vessel.

The liner 132 may be generally rectangular with two opposing ends each folded back upon themselves. This folding forms two support members 134 and 136 between which an unfolded portion of the rectangle will span, providing a surface upon which the wand torch 104 may rest while residing within the liquid containment pot 102. The spanning portion of the liner may be semi-flexible so as to add to the protection of the inside of the containment vessel. In addition, the removable liner 132 may be shaped to fit into grooves or other indentations placed within the container bottom and/or, so as to increase the stability of the containment pot when the lid is placed onto the pot and to increase the stability of the torch wand when it is also located within the containment vessel.

Figure 2:
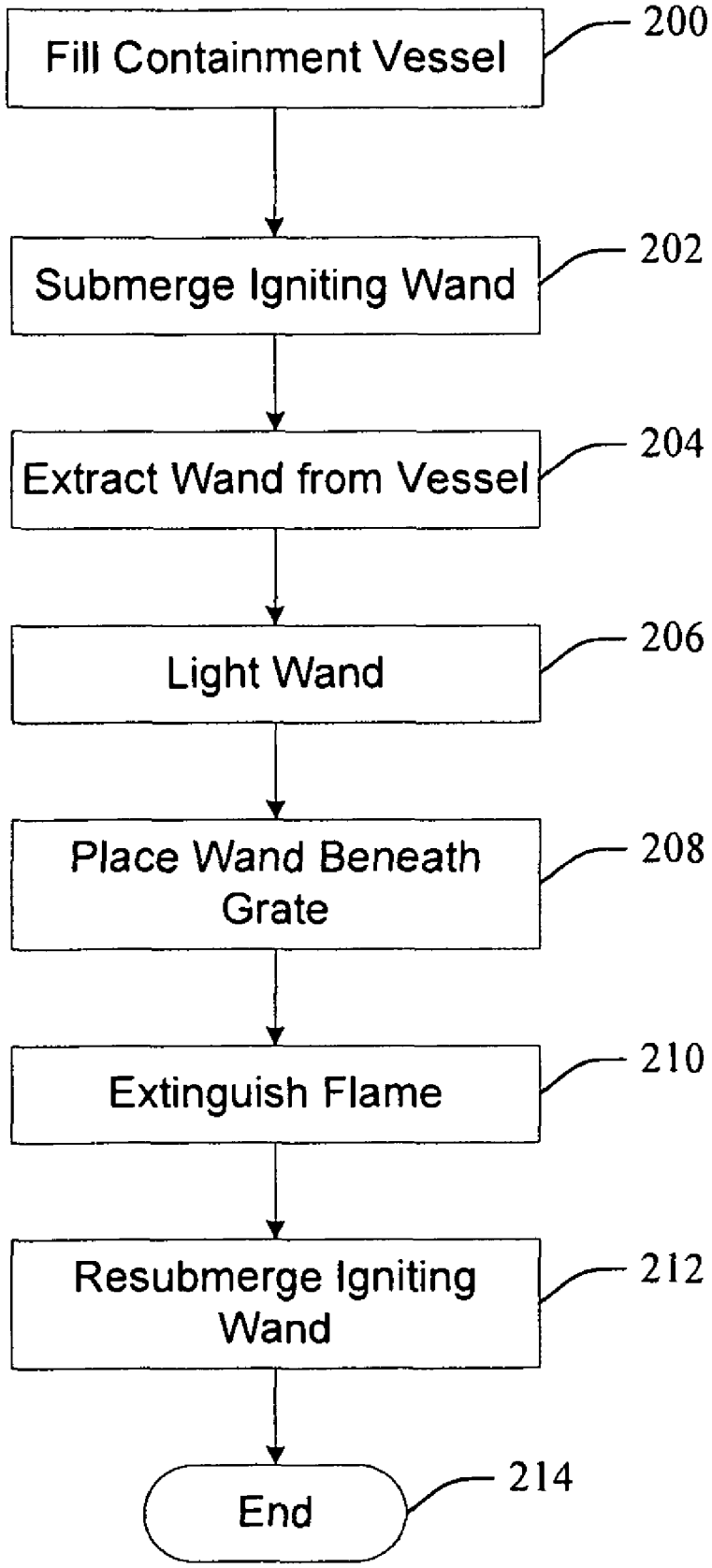
FIG. 2 illustrates operation of the fire lighter.

FIG. 2 illustrates a method of using the fire lighter 100. At 200, the containment pot 102 is filled with a flammable liquid. The flammable liquid may be, for example, kerosene or another lighter fluid. A certain level of flammable liquid is not necessary, but fluid should be at a level which submerges the removable liner and the igniting head. The level of fluid in the container should also not exceed a certain level otherwise the flammable liquid may overflow the vessel when the wand is submerged.

At 202 the wand torch 104 is placed within the containment pot 102 to soak in the flammable liquid. The soaking time for the igniting head 114 is dependent upon the type of material from which the igniting head 114 is composed. Each nonflammable head may have a different rate at which the flammable liquid is absorbed into its porous surface. The level of flammable liquid within the containment pot may also affect the length of time for which an igniting head 114 must be submerged, for example, if only half of the igniting head 114 is submerged absorption to the entire head will take a longer period than if the entire igniting head 114 is submerged. For some embodiments, an extended period of time may be required for the wand torch 104 to work properly because of the combination of fluid type, fluid available and igniting head material, where as with other embodiments only a short period of submersion in the flammable liquid is necessary.

The wand torch 104 must next be extracted from the containment vessel 102 at 204. Once the wand torch 104 has been given time so as to not drip flammable liquid outside of the containment vessel, the igniting head 114 may be lit at 206. Once lit, the wand torch 104 is placed in a fire place or wood stove beneath a grate containing fire starting materials at 208. The wand torch 104 may be placed beneath the grate using a utensil, for example, a pair of tongs or a gripping hook. The wand torch 104 may also be placed beneath the grate at 208 by hand since the wand material is not heated and may be cool to the touch of human skin.

After a period of time beneath the fire starting materials, the wand torch 104 may be removed at 210 and the fire on the igniting head 114 may be extinguished. For some embodiments of the fire lighter 100, once the flammable liquid bums off the igniting head 114 the flame will diminish and go out alone. The period for which the wand torch 104 must remain beneath a fuel grate is dependent upon the type of materials used for starting the fire. For example, certain types of wood burn at different temperatures and certain types of kindling ignite more quickly than others. In some uses, a fire grate containing pine and newspaper would ignite much more quickly than a fuel grate containing maple and dried leaves and grasses.

At 210 the wand torch 104 is easily extracted from beneath the fire grate. The handle 118 located at the end of the wand torch 104 always remains facing upward if lying upon a flat surface. The wand torch 104, therefore, is always "self-righting," for example, always able to be grasped by a pair of tongs or hooked poker. In addition, for the embodiments where the handle 118 is covered in an insulated material, the face-up look makes the wand easy to grasp by a human hand, whether or not the user is wearing an insulated glove.

After extracting from the lit fire and the flame on the igniting head 114 has been sufficiently extinguished, the igniting head 114 should be allowed to cool at 210. This cooling period ensures that if the igniting head 114 comes in contact with a flammable liquid or other flammable object that a fire will not unintentionally begin. Once a reasonable cooling period has occurred, the wand torch may be returned to the containment vessel 102 at 212, to again soak in a flammable liquid. The method ends at 214.

Embodiments of the fire lighter 100 may represent updated and improved variations of conventional fire lighters. This includes providing a more contemporary appearance that is stylistically more versatile than the appearance design of the vintage products. This is made possible at least in part by the use of materials and processes not contemplated when manufacturing some conventional fire starters.

The slip cast ceramic parts will likely offer cost advantages over the traditional cast iron and brass components, and new assembly techniques may also offer improvements and cost savings. For example, the use of sheet metal push-on/push nuts to attach the igniting head to the wand torch not only eliminates the need to add threads to the handle, but it replaces more expensive threaded fasteners which might be rendered useless should cross threading occur during assembly or disassembly.

The foregoing description of various aspects of the fire lighter has been presented for purposes of illustration and description. It is not intended to be exhaustive or to limit the fire lighter to the precise forms disclosed, and obviously, many modifications and variations are possible. Such modifications and variations that may be apparent to a person skilled in the art are intended to be included within the scope of the fire lighter as defined by the accompanying claims.

What is claimed is:

1. A fire lighter, comprising:

a containment pot that stores a flammable liquid;

a wand torch that removably inserts into the containment pot, wherein the wand torch includes:

a shaft;

a handle at one end of the shaft; and an igniting head located at an opposing end of the shaft, wherein the igniting head is removably affixed to the shaft through a non-threaded fastener, and wherein the igniting head is inserted into the flammable liquid and absorbs flammable fluid; and a removable liner insertable into the containment pot, the removable liner comprising an open mesh material configured to rest upon the inside bottom surface of the containment pot wherein the shaft is a single unitary structure not connected to another structure through a threaded fastener; wherein the shaft extends from outside of the igniting head into a through-hole of the igniting head and does not protrude out from the igniting head.

2. The fire lighter of claim 1, wherein the shaft is recessed within the igniting head.

3. The fire lighter of claim 2, wherein the shaft is secured in the through-hole with a first non-threaded fastener.

4. The fire lighter of claim 3, wherein the first non-threaded fastener is located entirely within the through-hole.

5. The fire lighter of claim 4, wherein the shaft is secured outside the through-hole with a second non-threaded fastener in the through-hole.

6. A method for using a fire lighter, comprising:

submerging a wand torch in a flammable fluid within a containment pot, wherein the wand torch comprises:

a shaft;

a handle at one end of the shaft; and a non-flammable igniting head located at an opposing end of the shaft, wherein the shaft extends into a through-hole of the igniting head and is secured therein by a push nut that is located only in the through-hole and the shaft is recessed in the through-hole, thereby not extending to an end of or from the through-hole; and lighting flammable fluid on the non-flammable igniting head after removal of the igniting head from the flammable fluid from within the containment pot.

7. The method of claim 6, the wand torch further comprising: a second push nut secured to the shaft outside of the through-hole, wherein the second push nut acts as a stop for movement of the igniting head.

8. The method of claim 6, wherein submerging the wand torch in the flammable fluid further comprises allowing the non-flammable igniting head to absorb the flammable fluid for a predetermined period of time.

9. The method of claim 8, wherein the predetermined period of time is based on the type of material the igniting head comprises.

10. The method of claim 6, wherein the shaft is a single unitary structure not connected to another structure through a threaded fastener and not formed from multiple structures fastened together through a threaded fastener.

11. The method of claim 10, wherein the shaft extends from outside of the igniting head into a through-hole of the igniting head and does not protrude out from the igniting head.

12. The method of claim 11, wherein the shaft is recessed within the igniting head.

13. A fire lighter, comprising:

a containment pot that stores a flammable liquid;

a wand torch that removably inserts into the containment pot, wherein the wand torch includes:

a shaft having first and second end regions, wherein the shaft is a single unitary structure not formed from multiple structures and not connected to another structure through a threaded fastener;

a handle affixed to the first end region of the shaft;

an igniting head with first and second opposing surfaces, wherein the second end region of the shaft extends through the first surface and into a through-hole of the igniting head and is recessed within and does not protrude out from the second surface; and first and second non-threaded fasteners that fasten the igniting head to the handle, wherein the first non-threaded fastener fastens to the shaft entirely within the through-hole, wherein the igniting head absorbs a flammable fluid.

14. The fire lighter of claim 13, wherein the second non-threaded fastener fastens to the shaft at the first surface and the second non-threaded fastener is recessed within the through-hole, wherein the first non-threaded fastener and the second non-threaded fastener maintain a general position of the igniting head.

15. The fire lighter of claim 14, wherein the first and second non-threaded fasteners are push nuts.

16. The fire lighter of claim 13, wherein the handle comprises a closed loop at an end of the handle.

17. The fire lighter of claim 13, further comprising a removable liner insertable into the vessel, the removable liner comprising an open mesh material configured to rest upon the inside bottom surface of the vessel.

18. The fire lighter of claim 13, wherein the igniting head is formed of a porous non-flammable material.

* * * * *